US005133262A

United States Patent [19]

Schaake et al.

[11] Patent Number: 5,133,262

[45] Date of Patent: Jul. 28, 1992

[54] PENETRATOR

[75] Inventors: Henning Schaake, Cologne; Jürgen Böcker, Oberhausen; Wilfried Becker, Ölde; Jürgen Winkelmann, Meerbusch, all of Fed. Rep. of Germany; Marc Berville, Bourges, France; Joel Leblond, Bourges, France; Patrick Montier, Bourges, France; Jean-Claude Sauvestre, Saint-Doulchard, France

[73] Assignees: Rheinmetall GmbH, Dusseldorf, Fed. Rep. of Germany; Etat Francais represente par le Delegue pour L' Armement, France

[21] Appl. No.: 228,349

[22] Filed: Jul. 15, 1988

[30] Foreign Application Priority Data

Jul. 18, 1987 [DE] Fed. Rep. of Germany ..... 3723909

[51] Int. Cl.[5] ..... F42B 12/06

[52] U.S. Cl. ..... 102/521; 102/501

[58] Field of Search ..... 102/501, 703, 517-527

[56] References Cited

U.S. PATENT DOCUMENTS

| | | | |
|---|---|---|---|
| H265 | 5/1987 | Bonde et al. . | |
| 2,996,012 | 8/1961 | Butler | 102/524 |
| 3,262,391 | 7/1966 | Shober | 102/521 |
| 3,301,186 | 1/1967 | Henry | 102/524 |
| 3,620,167 | 11/1971 | Romer et al. | 102/521 |
| 3,859,922 | 1/1975 | Kaplan et al. | 102/520 |
| 4,098,194 | 7/1978 | Miller et al. . | |
| 4,187,783 | 2/1980 | Campoli et al. . | |
| 4,284,008 | 8/1981 | Kirkendall et al. . | |
| 4,360,954 | 11/1982 | Burns et al. | 102/521 |
| 4,372,217 | 2/1983 | Kirkendall et al. | 102/521 |
| 4,603,636 | 8/1986 | Wallow | 102/521 |
| 4,638,738 | 1/1987 | Bisping et al. | 102/516 |
| 4,665,828 | 5/1987 | Auer | 102/519 |

FOREIGN PATENT DOCUMENTS

| | | |
|---|---|---|
| 3031722A1 | 10/1986 | Fed. Rep. of Germany . |
| 2027855 | 2/1980 | United Kingdom . |
| 2212251B | 2/1990 | United Kingdom . |

*Primary Examiner*—Charles T. Jordan

*Attorney, Agent, or Firm*—Spencer, Frank & Schneider

[57] ABSTRACT

A subcaliber projectile including a penetrator preferably made of tungsten heavy metal, and having a penetrator tip section and a section following thereafter and extending over the major portion of the penetrator length which is provided with an external thread (helical groove) or circumferential annular grooves to provide a form-locking connection with a discardable propelling cage sabot. To realize improved piercing power for the penetrator, the form-locking region is composed of annular grooves without a pitch, or of a fine metric thread having a thread valley, with a width of approximately one to three times the base width of the groove defining wall or of a thread peak. Preferably a more brittle material is employed in the front penetrator region than in the tail region, and a further indentation structure is incorporated in the first frontal thread turns or grooves of the form-locking region.

20 Claims, 1 Drawing Sheet

PENETRATOR

BACKGROUND OF THE INVENTION

The present invention relates to a penetrator for a subcaliber kinetic energy projectile. More particularly, the present invention relates to such a penetrator which is preferably made of a tungsten heavy metal and which includes a penetrator tip and a region following thereafter which extends over a major portion of the length of the penetrator, with this region being provided with a helical groove (formed, e.g. by an eternal thread) or a plurality of circumferential annular grooves to provide a form-locking connection with a partitioned discardable propelling cage sabot.

Kinetic energy projectiles in the form of subcaliber penetrators employed to pierce armor are required in ever increasing lengths so as to be able to develop the necessary piercing force in view of ever stronger armors. It is known to provide the penetrator over a large portion of its length with a thread or with circumferential annular grooves, with such thread or annular grooves being provided to establish a form-locking connection between a discardable propelling cage sabot and the penetrator during the firing acceleration and passage through the gun barrel. Due to the danger of breakage caused by the notch effect, the thread or grooves or annular rifling adversely influence the piercing power of the penetrator.

SUMMARY OF THE INVENTION

It is an object of the present invention to provide a penetrator of the above type which has a significantly improved piercing power.

The above object is basically achieved according to the present invention by an arrow type penetrator for a subcaliber kinetic energy projectile including a penetrator tip and a region following thereafter which extends over the major portion of the length of the penetrator and which is provided with means, including one of a helical groove and a plurality of annular grooves formed in the surface of the region, for providing a form-locking connection with a partitioned discardable propelling cage sabot, and wherein the root or bottom of each groove is flat and has a root width which is from one to three times the base width of the adjacent raised portions defining the groove.

Preferably, the root width is approximately one time the base width, and the groove is a helical groove defined by an external thread and formed by a fine double metric thread in which one thread has been removed down to the core diameter of the region of the penetrator.

According to further features of the invention, the region provided with the groove or grooves has a front section and a rear section, and the front section has at least one additional indentation formed in the groove bottom and extending into the core of the penetrator. Moreover, the material used for the front and rear portions of the penetrator preferably is provided with different strength and ductility properties.

The configuration, according to the invention, of the form-locking region between the penetrator and the propelling cage sabot segments, particularly at the bottom of the grooves or the bottom of the thread, in the form of a curve which is coaxial with the longitudinal axis over a length up to about three times, preferably one time, the base width of each thread peak or land between the annular grooves, constitutes a considerable improvement in the piercing power of the penetrator, particularly in use against modern multi-plate armors, brought about by a considerable reduction of the notch effect and the connected danger of breakage. The reduction of the notch effect becomes quite noticeable already if the thread bottom is widened slightly (e.g. half a base width of a thread peak).

The invention will be described in greater detail below with reference to embodiments illustrated in the attached drawing figures.

DETAILED DESCRIPTION OF THE PREFERRED EMBODIMENTS

Figure 1:
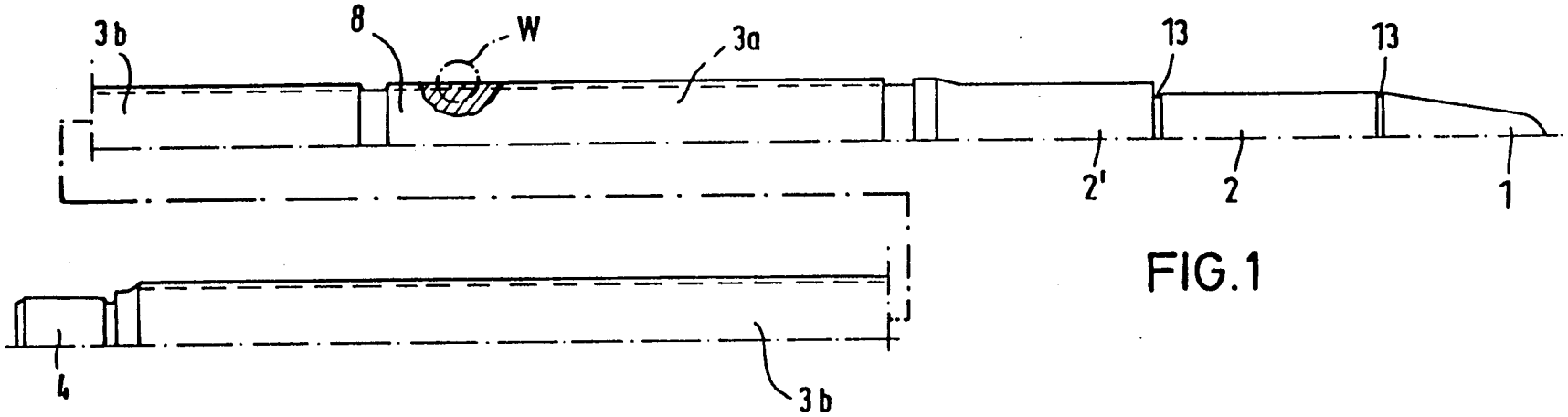
FIG. 1 is a partial side view of a penetrator according to the invention.

The penetrator shown in FIG. 1 includes, at its front end, a tip 1 followed by two shorter sections 2 and 2', with the diameter of section 2' being larger than the diameter of section 2. Section 2', in turn, is followed by a two-part form-locking region **3*a*, 3*b* provided with form-locking means, e.g. an external circumferential thread or annular grooves, for a discardable propelling cage sabot. These sections 3*a*, 3*b* extend approximately over three-quarters of the length of the penetrator, with the first section 3*a* extending approximately over one quarter (i.e. the second quarter), and the second section 3*b* extending over approximately the last two quarters of the penetrator length. The section 3*b* is followed by a tail section 4 for the attachment of a guide mechanism, for example, a fin stabilizing arrangement, to the penetrator body. The length distribution of form-locking sections 3*a* and 3*b*** must be adapted to the respective penetrator material employed. Preferably, the penetrator material is a tungsten heavy metal or deriched uranium.

According to the basic concept of the present invention the form-locking arrangement in the sections **3*a* and 3*b* includes either a helical groove or a plurality of annular grooves formed on the circumference of the sections 3*a* and 3*b***, with the groove width at its bottom or root being at least one time, and up to three times the base width of the raised portions on either side of and defining the groove or grooves.

Figure 2:
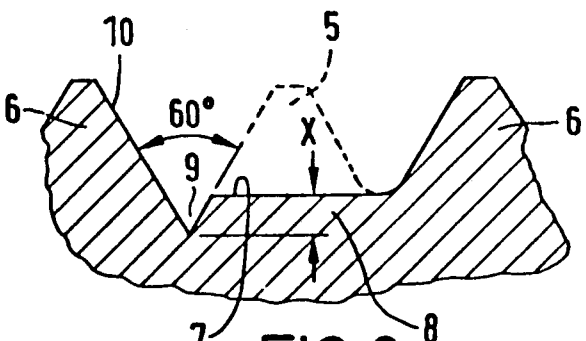
FIG. 2 shows a detail of the encircled portion W of the penetrator of FIG. 1.

In the preferred embodiment, sections **3*a*, 3*b* are preferably initially provided with a fine, metric, double thread 5, 6 after which the peaks of thread 5, shown in dashed lines in FIG. 2, have been worked or turned down to the core diameter of the penetrator so that a correspondingly wide thread valley or helical groove 7 results between adjacent peaks of the remaining thread 6. The peaks of the remaining thread 6** preferably have a trapezoidal cross section as shown. However, other peak shapes, such as, for example, a sawtooth peak profile, rectangular peaks sloped on one side, or rounded circumferential grooves without a pitch and with a large distance between the raised portions, are also possible for the form-locking arrangement.

In the embodiment of the form-locking arrangement shown in FIG. 2, the root width of the groove or valley 7 is at least equal to the base width of the peaks of the thread 6. However as noted above, the root width of the groove 7 may be up to three times the base width of the peaks of thread 6. Additionally as indicated above, instead of a helical groove formed by a thread, the form-locking means may be constituted of a plurality of annular grooves, in which case, the peaks 6 would simply represent annular raised portions or lands and the groove 7 would represent a circumferential groove.

According to FIG. 2, an indentation 9 extending into the penetrator core 8 is additionally provided in the valley or groove 7 of the frontal section 3*a*. This indentation 9 extends the side 10 of peak 6 which is oriented toward or faces tip 1 into the core 8 by a radial dimension X. Preferably, indentation 9 has a V shape and forms an angle of 60° or shown. Dimension X is about 25% of the profile depth or height of the thread or the raised portions defining the valley or groove 7.

Figure 3:
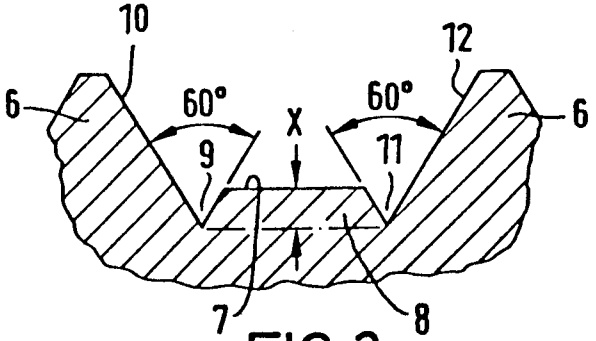
FIG. 3 shows a further embodiment of the encircled portion W.

As shown in FIG. 3, a second indentation 11 which is configured to correspond to indentation 9, may be provided which extends the side 12 of the peak 6 facing away from tip 1 into core 8. The thread is, for example, a standard thread M 27×4. The configuration of the threaded or grooved regions 3*a* and 3*b* according to the invention considerably improves the piercing power of the penetrator. The reason for this is the reduction in the notch effect resulting from the removal of the thread 5 and the thus produced widening of valley or groove 7. The arrangement of indentations 9 and 11 in the frontal region of section 3*a* constitute possible desired break locations for penetration of a first armor plate. In this way it is ensured that the penetrator is able to positively break off piece by piece from the front to the rear and consumes itself from the front to the rear. Undesirable premature break-up in the central or even rear penetrator region is thus made impossible.

In the region of section 3*b* the thread or the annular groove is configured as shown in FIG. 2, except that the additional indentation 9 is here omitted.

As further shown in FIG. 1, preferably annular grooves or indentations 13 are provided between the tip 1 and the section 2, and between sections 2 and 2'.

To even further improve the piercing power, different materials are employed for the penetrator, for example different tungsten-heavy metal compositions sintered together from pure metallic tungsten powder, or deriched uranium. Also employed or set are different degrees of solidification or forging and different material properties. For example, a high strength, e.g., $1750 N \cdot mm^{-2}$, and a low ductility of less than 2%, preferably about 1.5% are selected for about one third of the front length of the penetrator and a strength, e.g., $1450 N \cdot mm^{-2}$, which is reduced compared to the front length portion, e.g., the first third, and a high ductility of more than 5%, preferably about 6% to 8%, are set for the remaining length at the rear.

The different materials or material properties improve the piercing behavior in structured multi-plate targets and produce a uniform, sharp-edged decomposition of material during passage through the target. At the same time, the penetrator trajectory in the structured target is much less interfered with and damaging deflections of the remainder of the penetrator do not occur. Breaking of the penetrator in the rear portion of the projectile body when it hits the target is reliably avoided.

The various material settings, particularly in conjunction with indentations 9, 11 and 13, demonstrate the above-described improvement of the piercing power and an increase in the final ballistic effect.

It will be understood that the above description of the present invention is susceptible to various modifications, changes and adaptations, and the same are intended to be comprehended within the meaning and range of equivalents of the appended claims.

What is claimed is:

1. In an arrow type heavy metal penetrator for a subcaliber kinetic energy projectile including a penetrator tip and a region following thereafter which extends over the major portion of the length of the penetrator, said region being provided with means for providing a form-locking connection with a partitioned discardable propelling cage sabot, with said means including one of a helical groove and a plurality of parallel annular grooves formed in the surface of said penetrator in said region; the improvement wherein: each said groove has a flat bottom and a rot width which is from approximately one to three time the base width of the adjacent raised portions defining the groove; said region has a front section and a rear section each provided with said means; and a said front section has at least one additional indentation formed in the groove bottom and extending into the penetrator.

2. A penetrator as defined in claim 1, wherein: said root width is approximately one time said base width.

3. A penetrator as defined in claim 1 wherein said means is a plurality of parallel annular grooves separated by annular lands of a uniform shape which constitute said raised portions.

4. A penetrator as defined in claim 1 wherein the depth of said additional indentation is approximately 25% of the height of said raised portion defining the respective groove.

5. A penetrator as defined in claim 1 wherein said front section is disposed in the region of the second quarter of said length of said penetrator.

6. A penetrator as defined in claim 5 wherein said rear section extends over approximately the last two quarters of the length of said penetrator.

7. A penetrator as defined in claim 1, wherein said at least one additional indentation is an extension of a side of the raised portion defining the respective groove which is oriented toward said tip of said penetrator.

8. A penetrator as defined in claim 7, wherein a further additional indentation is provided in said groove bottom in said front section and extending into said penetrator with said further additional indentation being an extension of a side of the raised portion defining the respective groove which faces away from said tip of said penetrator.

9. A penetrator as defined in claim 1, wherein the strength of the penetrator material in at the least front region of said front section is greater than in the region of said rear section.

10. A penetrator as defined in claim 9, wherein the material of said penetrator has a strength of approximately $1700 N \cdot mm^{-2}$ in said front region of said front section and of approximately $1450 N \cdot mm^{-2}$ in said rear section.

11. A penetrator as defined in claim 9 wherein said material of said penetrator has a ductility of less than 2% in the front third of the penetrator length, and a ductility of more than 5% in the region of said rear section.

12. A penetrator as defined in claim 11 wherein the ductility of said penetrator material in the front third of the penetrator length is approximately 1.5%.

13. A penetrator as defined in claim 12 wherein the ductility of said penetrator material in the region of said rear section is approximately 8%.

14. A penetrator as defined in claim 1 wherein said penetrator is formed of a tungsten heavy metal.

15. A penetrator as defined in claim 1 wherein the strength of the penetrator material in the front third of the penetrator length is greater than that in the remainder of its length.

16. A penetrator as defined in claim 15 wherein the material of said penetrator has a strength of approximately $1700N \cdot mm^{-2}$ in said front third and of approximately $1450N \cdot mm^{-2}$ in said remainder of its length.

17. A penetrator as defined in claim 16 wherein said material of said penetrator has a ductility of less than 2% in the front third of the penetrator length, and a ductility of more than 5% in said remainder of its length.

18. A penetrator as defined in claim 17 wherein: the ductility of said penetrator material in the front third of the penetrator length is approximately 1.5%, and the ductility of said penetrator material in said remainder of its length is approximately 8%.

19. A penetrator as defined in claim 1, wherein said means is a helical groove defined by an external thread which constitutes said raised portion.

20. In an arrow type heavy metal penetrator for a subcaliber kinetic energy projectile including a penetrator tip and a region following thereafter which extends over the major portion of the length of the penetrator, said region being provided with means for providing a form-locking connection with a partitioned discardable propelling cage sabot, with said means including a groove formed it eh surface of said penetrator in said region; the improvement wherein: said means is a helical groove defined by an external thread, with said groove having a flat bottom and a root width which is from approximately one to three time the base width of the adjacent raised portions of said external thread.

* * * * *